US005239168A

United States Patent [19]

Durst, Jr. et al.

[11] Patent Number: 5,239,168

[45] Date of Patent: Aug. 24, 1993

[54] POSTAGE METER WITH BARCODE PRINTING CAPABILITY

[75] Inventors: Robert T. Durst, Jr., Fairfield; Kevin D. Hunter, Stratford; Jose Pastor, Westport, all of Conn.

[73] Assignee: Pitney Bowes Inc., Stamford, Conn.

[21] Appl. No.: 737,528

[22] Filed: Jul. 29, 1991

[51] Int. Cl.[5] ..... G07B 17/02

[52] U.S. Cl. ..... 235/432; 364/464.02

[58] Field of Search ..... 364/464.02, 464.03; 235/432

[56] References Cited

U.S. PATENT DOCUMENTS

| | | | |
|---|---|---|---|
| 3,987,457 | 8/1976 | Check, Jr. et al. . | |
| 4,301,507 | 11/1981 | Soderberg et al. | 364/464 |
| 4,831,554 | 5/1989 | Storace et al. | 364/519 |
| 4,868,757 | 9/1989 | Gil | 364/464.02 |
| 4,934,846 | 6/1990 | Gilham | 235/432 |
| 5,065,000 | 11/1991 | Pusic | 235/381 |
| 5,072,397 | 12/1991 | Barns et al. | 364/464.02 |

*Primary Examiner*—John Shepperd

*Attorney, Agent, or Firm*—Robert H. Whisker; Melvin J. Scolnick

[57] ABSTRACT

A postage meter having the capability to print a zip code in bar code form. The postage meter includes an input for input of a postage value and input of a destination zip code, a display, a printer for printing an indicia on a mail piece, the indicia including a representation of a postage value and a representation of a destination zip code in bar code form. The postage meter also includes accounting means for accounting for expended postage and a controller responsive to the input. The controller controls the meter to receive a postage value and display a prompt requesting input of the destination zip code, convert the zip code to bar code form and add the bar code to the indicia. When a destination zip code is input the postage meter resets the postage value in accordance with a bar code discount. In one embodiment the postage meter of the subject invention may include a sensor for determining the position of the lower edge of the mail piece so that the bar code may be printed in accordance with regulations of a postal service. In another embodiment of the subject invention the postage meter includes a port for communication with a remote device and the remote device determines the amount of any postage discount.

16 Claims, 7 Drawing Sheets

POSTAGE METER WITH BARCODE PRINTING CAPABILITY

BACKGROUND OF THE INVENTION

This invention relates to postage meters. More particularly, it relates to postage meters having the capability to print supplemental information together with an indicia representative of the postage for a mail piece.

Postage meters are well known devices which print indicia representative of specified postage amounts on mail pieces. Such meters include a printing mechanism for printing the indicia, which will typically include the postage amount, date, meter serial number and an arbitrary, fanciful image to discourage counterfeiting. Such meters also include an accounting mechanism which is set, or charged, to allow printing of a specified amount of postage upon payment to a postal service or its agent. As each indicia is printed the amount in the accounting mechanism is decremented by the corresponding amount to assure that the total of postage represented by all the indicia printed does not exceed the amount paid to the postal service. Postage meters include means, such as physically secure housing, to assure that amounts recorded in the accounting mechanism are not improperly altered and that he printing mechanism is not operated without accounting for the postage expended. Such postage meter are described in U.S. Pat. Nos. 3,978,457; to:Check, Jr. et al.; issued: Aug. 31, 1976, and 4,301,507; to Soderberg et al.; issued: Nov. 17, 1981, which are hereby incorporated by reference.

Present regulations of the U.S. Postal Service provide for a discount on postage for mailers who include the zip code of the addressee in barcode form (hereinafter sometimes referred to as a "Postnet" barcode) since such barcodes greatly facilitate mail sorting operations by the Postal Service. Initially such discounts were available only to large volume mailers who presorted mail. However, recent participated changes to the regulations will provide a flat rate discount for single mail pieces marked with the Postnet barcode. This discount increases the desirability of providing the small volume mailer with a convenient mechanism for printing barcode. Also, beyond any discount and perhaps more importantly, barcoded mail is likely to be delivered both more reliably and more promptly.

BRIEF SUMMARY OF THE INVENTION

The above objects are achieved and the disadvantages of the prior art are overcome in accordance with the subject invention by means of a postage meter which includes an input for input of a postage value and a destination zip code, a display, a printer for printing an indicia on a mail piece, the indicia including a representation of said postage value and a representation in barcode form of said destination zip code, accounting means for accounting for said postage value when said indicia is printed, and a controller responsive to said input. The controller controls the postage meter to receive the postage value and display a prompt requesting input of the destination zip code, then to convert the zip code to barcode form and add the barcode to the indicia, and then to print the indicia and account for the postage value.

(As used herein the term "postage meter" includes both "meters", which limit the total postage value which can be printed by the meter to a previously set amount; and registers, which accumulate the total postage value printed and where the user is periodically billed for postage expended.

Further, as used herein the term barcode includes the well known bar/half-bar code used by the United States Postal Service and other suitable machine-readable representations of postal information.)

In accordance with one aspect of the subject invention the postage meter includes an input for input of a barcode discount and the postage value is reset in accordance with the barcode discount when the destination zip code is input.

In accordance with another aspect of the subject invention the postage meter is conditioned to display the prompt by input of a barcode signal.

In accordance with another aspect of the subject invention the postage meter includes a sensor for determining the position of the lower edge of the mail piece and the barcode representation is printed in relation to the lower edge.

In accordance with another aspect of the subject invention the postage meter includes a port for communication with a remote device and the remote device determines the discounted postage value.

BRIEF DESCRIPTION OF THE DRAWINGS

Preferred embodiments of the subject invention will be described with reference to the following drawings; wherein identical elements are given the same reference number.

DETAILED DESCRIPTION OF THE PREFERRED EMBODIMENTS OF THE SUBJECT INVENTION

Figure 1:
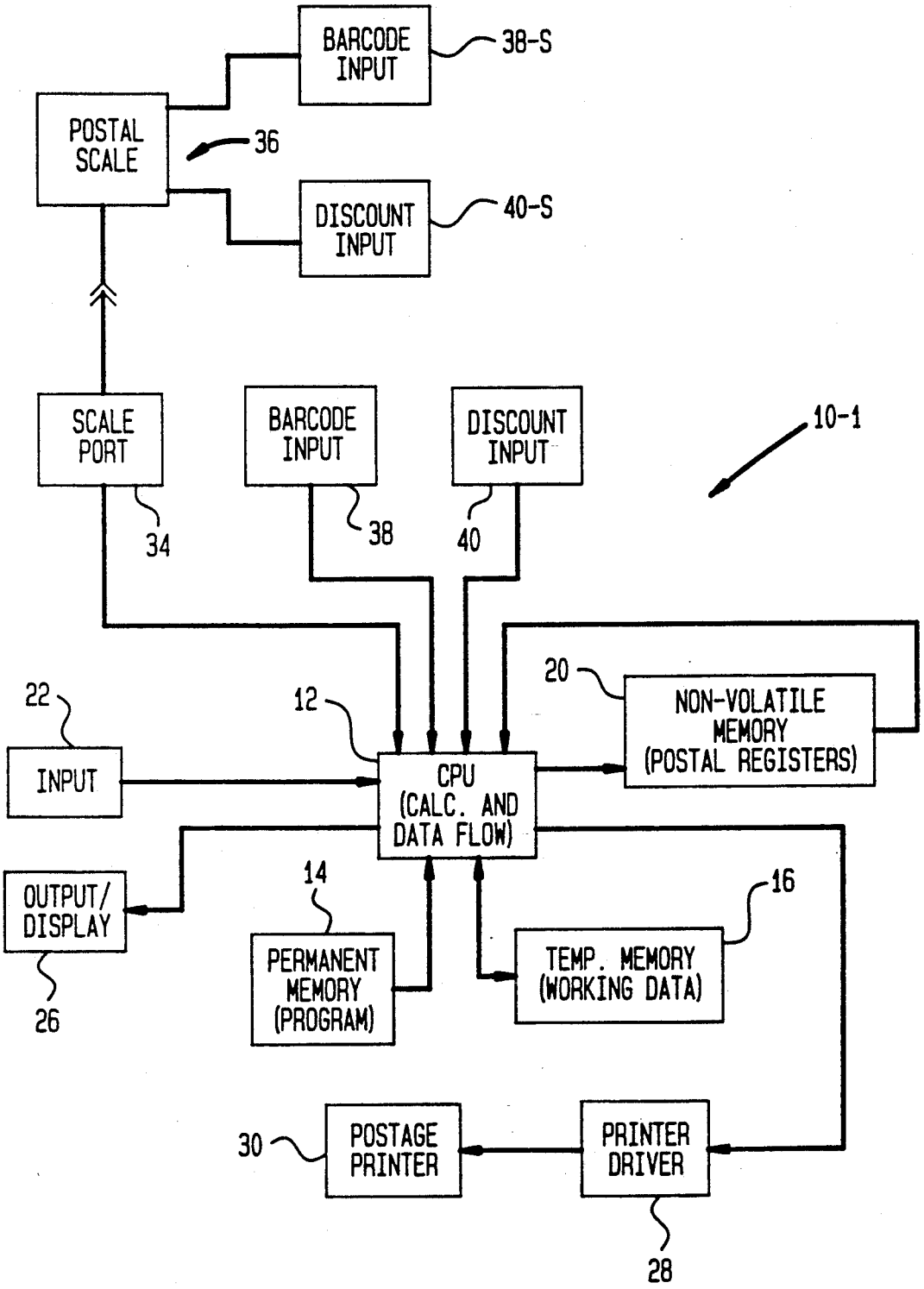
FIG. 1 is a postage meter in accordance with an embodiment of the subject invention.

FIG. 1 shows a schematic block diagram of a postage meter in accordance with one embodiment of the subject invention.

Electronic postage meters are know and are described, for instance in U.S. Pat. Nos. 3,978,457 and 4,301,507, described above. Control for meter 10-1 is provided by microprocessor, or CPU, 28 which performs two basic functions: calculations based on input data, and control of the flow of data between the three memory units provided. The first memory unit is permanent memory, or ROM, 14 which stores the specific program code, in a manner well known to those skilled in the art, for operation of meter 10-1 in performing 1 data calculations in accordance with certain predetermined inputs, as well as performing other routines for operation system 10-1. Memory unit 16 is a temporary memory, or RAM, for temporary storage of working data for CPU 12 in a well known manner. Memory unit 20 is a non-volatile memory, or NVM, which stores certain critical information, particularly during meter shut-down or power failures. Information stored in RAM 16, which represents crucial accounting functions such as descending balances in a descending register or ascending credits in an ascending register and the like are stored in the non-volatile memory 20 where they are retained while meter 10-1 is deenergized and recalled upon a subsequent start-up. NVM 20 may be battery backed RAM, or other conventional memory devices which are capable of retaining information when deenergized, and the operation of postage meters in storing critical accounting information in such non-volatile memory is well known in the art. Meter 10-1 operates in accordance with data applied from input 22. Typically, input 22 will include a numeric key pad but may include mechanical value setting devices or switches in place of or in addition to such keypad. Data is input to CPU 12 under control of the program stored in ROM fourteen. At any time during the operation of meter 10-1, the contents of RAM 16 including appropriate credit or debit balances, or other values in accordance with various features of meter 10-1, can be made available by an appropriate instruction provided by input 22. Information in RAM 16 may also be provided through CPU 12 to output display 26, which is preferably an LED display or a similar display capable of displaying alpha numeric information.

Under control of CPU 12, when appropriate postal data is entered through input 22, printer driver 28 will control postage printer 30 to print an indicia including a representation of the postage amount for which meter 10-1 has accounted. Details of suitable apparatus are described, for instance, in above referenced U.S. Pat. No. 3,978,457.

In accordance with one embodiment of the s invention postage printer 30 includes a conventional letterpress printer for printing the representation o postage value and other arbitrary fanciful elements of indicia which are included to provide assurance against counterfeit indicia, and a matrix, or similar type print mechanism, for printing an additional message which is stored in a memory of meter 10-1; and which in accordance with the subject invention will include a barcode representation of the destination zip code for the mail piece on which the indicia is printed, as will be described further below. A postage meter having the capability to print additional messages stored in memory is described in U.S. Pat. No. 4,831,554, to: Storace et al.; issued: May 16, 1989, which is hereby incorporated by reference.

In accordance with another embodiment of the subject invention postage printer 30 may be only a matrix printer or other similar print mechanism, and assurance against use of counterfeit indicia is provided by inclusion of encrypted information in the indicia as is described, for example, in U.S. Pat. No. 4,829,568; to: Clark et al.; issued: May 9, 1989, which is hereby incorporated by reference.

Meter 10-1 further includes a scale port 34 for connection to a postal scale 36 in a conventional manner, well known in the art. Postal scale 36 weighs mail pieces, computes appropriate postage values in accordance with the weight and other postal information, and inputs the postage value to CPU 12 through scale port 34, as is described in U.S. Pat. No. 4,320,461; to: Dlugos; issued: Mar. 16, 1982, In general, and as is well known in the art, scale port 34 is constructed so that any information for the operation of meter 10-1 which may be input through input 22 may also be generated at a remote device and input through scale port 34.

Meter 10-1 also includes barcode input 38 for input by an operator of a signal to condition CPU 12 to operate in a barcode printing mode as will be described further below, and a discount input for input of a discount amount. In accordance with one embodiment of the subject invention, discount input 40 may be a switch mechanism for the input of various values, such as the well known "thumbwheel" switches, or in accordance with another embodiment, may be a switch for input by an operator of a signal to condition CPU 12 to operate in a mode where a discount amount may be input through input 22, as will be described further below.

Barcode input 38 and discount input 40 are shown separately for convenience of description, but those skilled in the art will readily recognize that they will be preferably incorporated into input 22 in a conventional manner.

Figure 2:
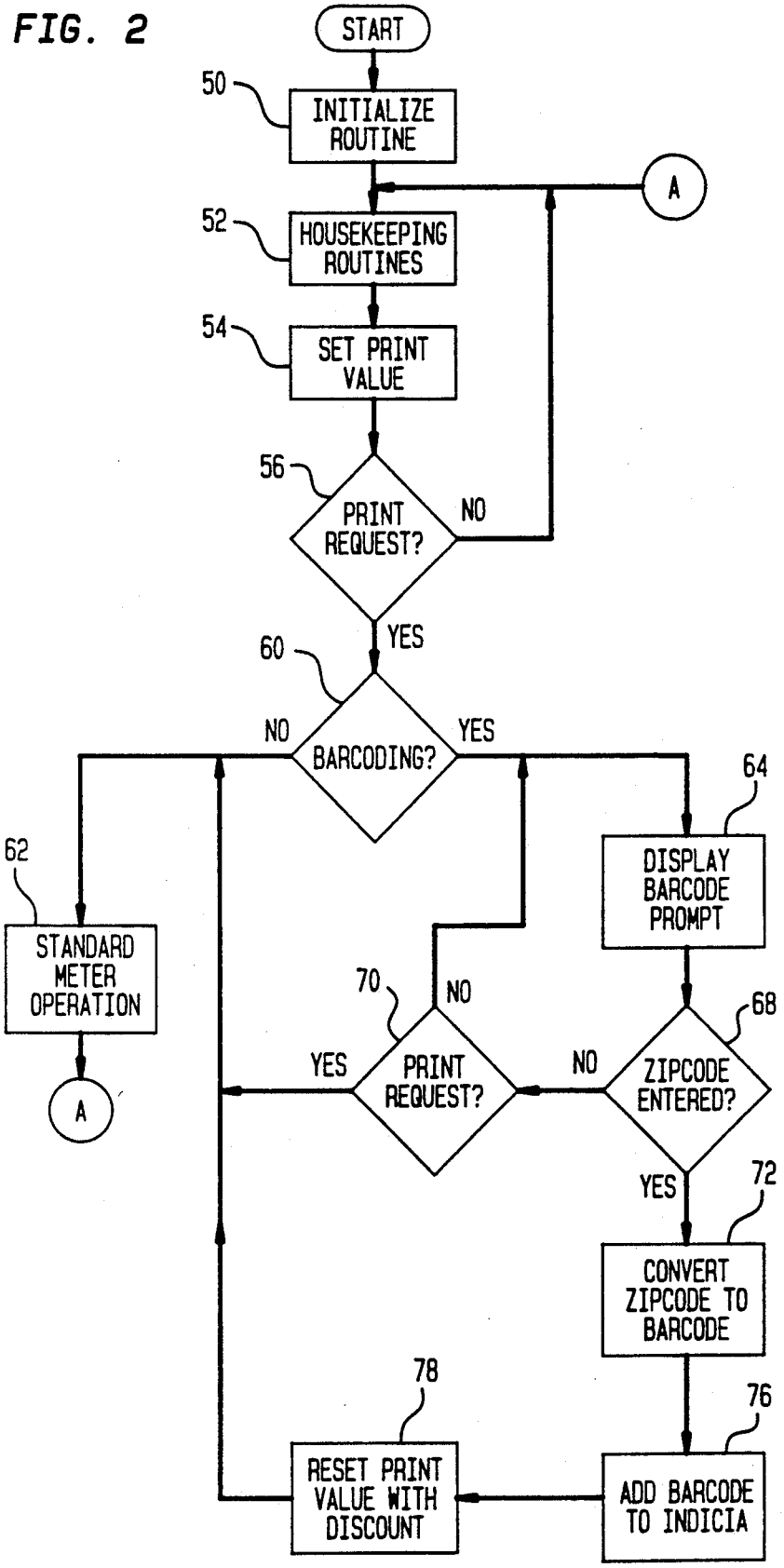
FIG. 2 is a flow chart of the operation of the postage meter of FIG. 1 in printing an indicia.

FIG. 2 shows a flow chart of the operation of postage meter 10-1. Once meter 10-1 is installed the meter program stored in ROM 14 proceeds through its initializing routines shown at block 50. There after, as is described more fully below meter 10-1 will continuously loop through its routines to check meter perameters and input conditions and to print postage as desired by the user. At block 52 meter 10-1 precedes through housekeeping routines such as those described in the above referenced U.S. Pat. No. 4,301,507 for monitoring various meter conditions.

At 54 the program enters a routine to set the print value, i.e., the postage value to be included in the indicia. Typically the print value will remain set at the previously selected value since the majority of mail pieces will probably required the minimum postage and/or the same postage as the previous mail piece.

In the above described embodiment wherein the postage value representation is printed by letterpress printing the printing operation typically will include setting print wheels to the selected value. Such operation is described in the above referenced U.S. Pat. No. 4,831,554. Alternatively, in the above described embodiment where an indicia including encrypted information is printed with a matrix printer, setting the print value requires updating of the indicia image stored in RAM 16.

At 56 the program then tests to determine if an operator has input a print request. If no print request has been made the program returns to the housekeeping routines at 52.

If a print request has been made, at 60 the program tests to determine if an operator has input a barcode to condition operation of meter 10-1 for barcoding. If meter 10-1 is not conditioned for barcoding, at 62 the program controls meter 10-1 to print an indicia in accordance wit standard meter operation as is well known in the art, and returns to the housekeeping routines at 52.

If meter 10-1 has been conditioned for barcoding, then at 64 CPU 12 controls display 26 to display a predetermined prompt message prompting the operator to input the destination zip code, and at 68 test to determine if the destination zip code has been entered.

If no zip code has been entered, then at 70 the program again tests to determine if a second print request has been entered. If a second print request has been entered the program continues to standard meter operation at 62, as described above. Thus, for example, if a mail piece has already been barcoded an operator may bypass barcoding operation by entering a second print request.

If no second print request has been entered the program loops through 62 to continue display of the prompt.

When the program detects that the destination zip code has been entered at 68, then at 72 the program converts the entered zip code to a barcode image, and then at 76 adds the barcode image to the portion of the indicia which is stored in RAM 16 for incorporation when the indicia is printed.

Then at 78 the program resets the print value less the barcode discount amount and continues to 62 for standard meter operation.

Figure 3:
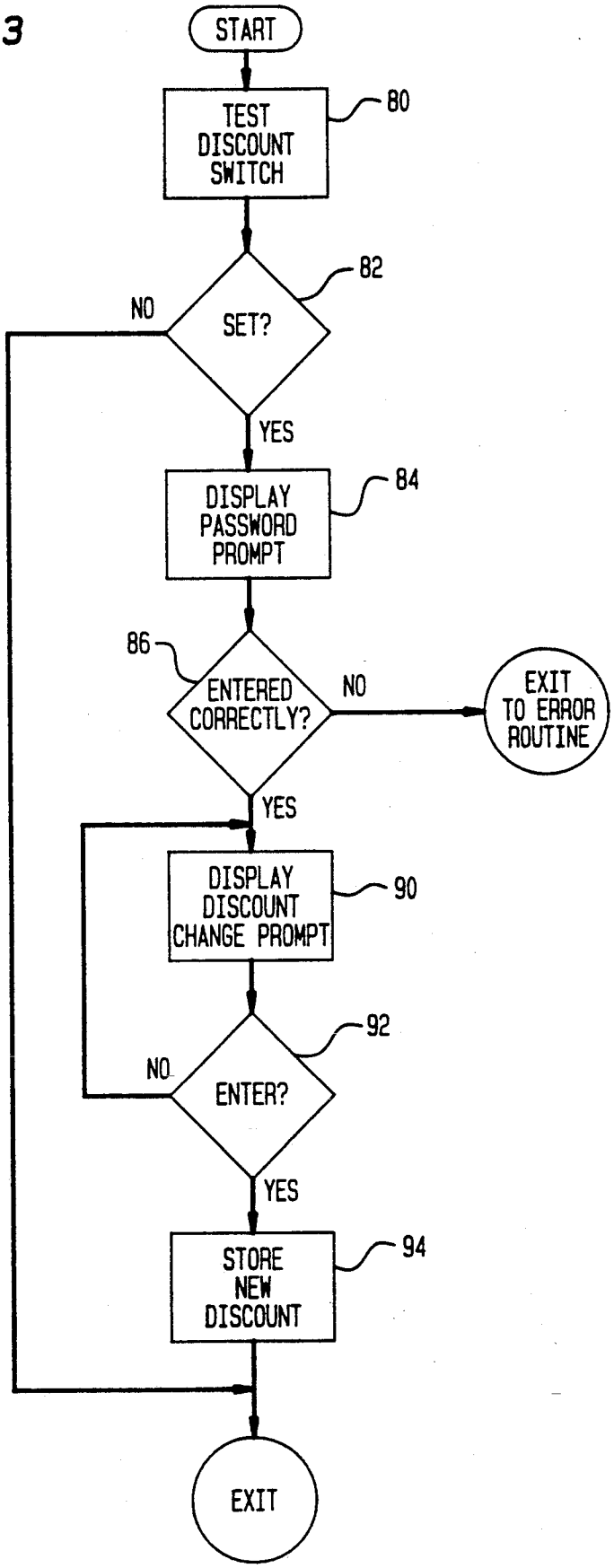
FIG. 3 is a flow chart of the operation of the postage meter of FIG. 1 in changing a discount.

FIG. 3 shows a flow chart of the operation of meter 10-1 in an embodiment where the discount amount is entered through input 22.

At 80 the program tests to determined if the operator has input a signal to condition meter 10-1 for input of the discount amount.

If, at 82 the program determines that meter 10-1 is not so conditioned the program exits. Otherwise, at 84 CPU 12 will control display 26 to display a password prompt, prompting an operator to input a password. At 86 the program tests to determine if an appropriate password has been entered, and if not exits to an error routine.

If an appropriate password is entered then at 90 CPU 12 controls display 26 to display an enter discount prompt. At 92 the program tests to determine if the new discount amount has been entered, and if not return to 90 to continue to display the prompt.

If the new amount has been entered then at 94 the program stores the new discount amount in a predetermined location in RAM 16 The new discount amount will be stored in NVM together with other critical information, in a conventional manner, if the meter is deenergized.

Returning to FIG. 1, it will be recalled that scale port 34 is constructed so that all inputs through input 22, including barcode input 38 and discount input 40 may also be generated remotely and input through scale port 34. Accordingly, the discount may be determined or the barcode input generated in a modified postal scale 36 and input through scale port 34 for operation of meter 10-1 in substantially the manner shown in FIG. 2.

In accordance with one embodiment the discount amount is determined by postal scale 36 which generates a barcoding signal for input through port 34, inputs the discount amount through port 34, and then determines the appropriate undiscounted postage value for the mail piece in a conventional manner for input through port 34. As noted above meter 10-1 will response to these inputs in the same manner as though they were input by an operator and the operation of meter 10-1 is exactly is shown in FIG. 2. The minor modifications to postal scale 36 necessary to generate a barcoding signal and determine a discount amount are well within the capabilities of those skilled in the art and need not be discussed further here for an understanding of the subject invention.

As with barcode input 38 and discount input 40, barcode input 38-s and discount input 40-s are shown separately from postal scale 36 in FIG. 1 for ease of description, but those skilled in the art would recognize that such inputs would preferably be incorporated in the keyboard of scale 36 for input by an operator of a barcode signal and discount amount, as described above.

In another embodiment of the subject invention, rather then inputting the discount amount postal scale 36 may compute the discounted postage value, treating barcoded mail as another mail class in a purely conventional manner and input the discounted postage value through port 34 together with a barcoding signal. In this embodiment the operation of meter 10-1 would be as shown in FIG. 2, except that the value resetting operations at 78 would be eliminated or bypassed.

Figure 4:
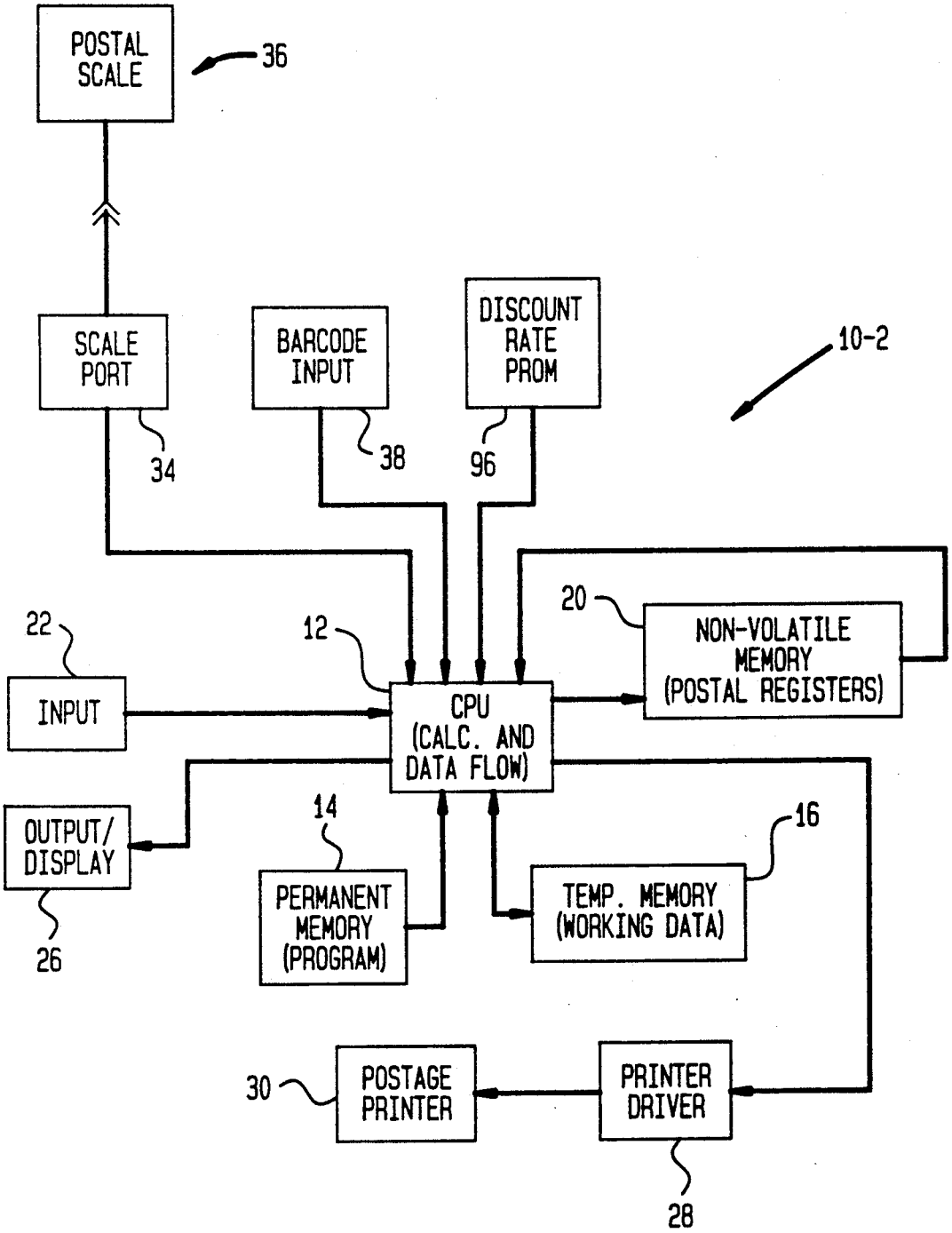
FIG. 4 is a postage meter in accordance with another embodiment of the subject invention.

Presently, it is anticipated that regulations of the U.S. Postal Service provide for a fixed discount amount which is deducted from the postage for any mail piece which is marked with a destination zip code, as has been described above. However, future regulations, or the regulations of other countries, may provide for a barcode discount which varies with the postage amount. Accordingly, FIG. 4 shows postage meter 10-2 which includes a capability for providing variable discounts.

In meter 10-2 CPU 12, memories 14, 16, and 20, input 22, output 26, printer driver 28, postage printer 30, scale port 34, and barcode input 38 function substantially as described with respect to FIG. 1, and need not be discussed further here for an understanding of the subject invention. Meter 10-2 also includes discount rate PROM which stores a plurality of discounted postage values which may apply to a mail piece depending upon the initial postage value.

Figure 5:
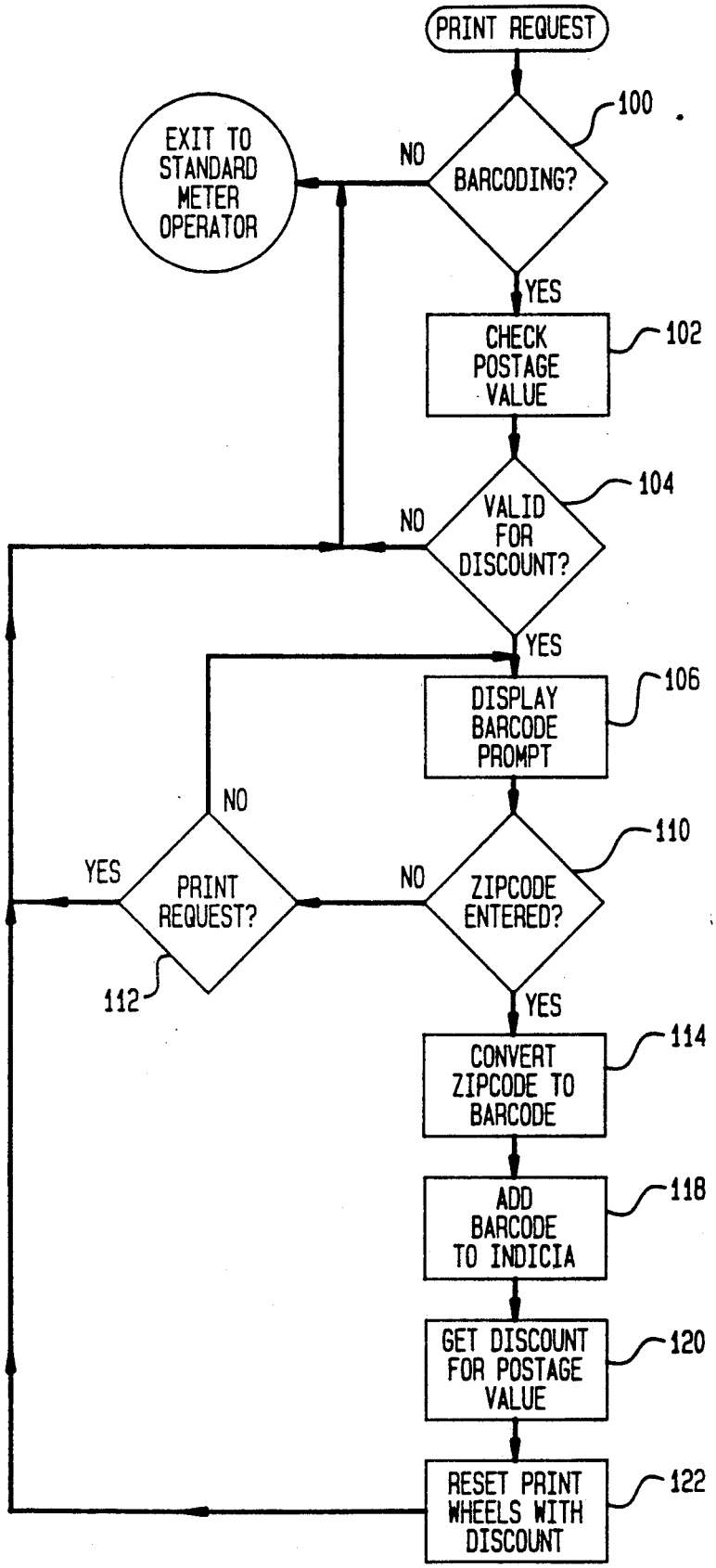
FIG. 5 is a flow chart of the operation of the postage meter of FIG. 4.

FIG. 5 shows a flow chart of the operation of meter 10-2 in accordance with one embodiment of the subject invention.

In regard to FIG. 5, operation of the program for meter 10-2 is identical to that described for meter 10-1 in FIG. 2 up to the point where the first print request is generated. And accordingly FIG. 5 begins when the first print request is received, where at 100 the programming tests to see if CPU 12 has been conditioned for barcoding. If not the program exits to the standard meter operation without barcoding as described above.

If CPU 112 has been conditioned for barcoding then at 102 the program checks the postage value and at 104 determines if that value is valid for a discount. That is, the program tests to determine if the postage value received is a value for which a barcode discount is possible, or is, for example, a value which could only apply to a parcel or other mail piece not eligible for discount under the schedule stored in PROM 96. If the postage value is not valid for discount the program again exits to standard meter operation routines, as described above.

If the postage value is valid for discount then at 106 CPU 112 controls display 26 to display a barcode prompt prompting an operator to enter a destination zip code through input 22.

At 110 the program tests to determine if a zip code has been entered, and if not at 112, tests to determine if a second print request has been received. If a second print request is received the program again exits to the standard meter operation routines. Otherwise the program continues to loop through 106.

When a zip code is entered then at 114 the program converts the entered zip code to a barcode representation of that zip code and at 118 adds the barcode representation to the image of the indicia stored in RAM 16.

Then at 120 the program uses the initial, undiscounted postage value to access the data stored in PROM 96 and determine the corresponding discounted postage value, and at 122 resets the print value with that discounted postage value, as described above. The program then exits to the standard meter operations routine as described above.

Figure 6:
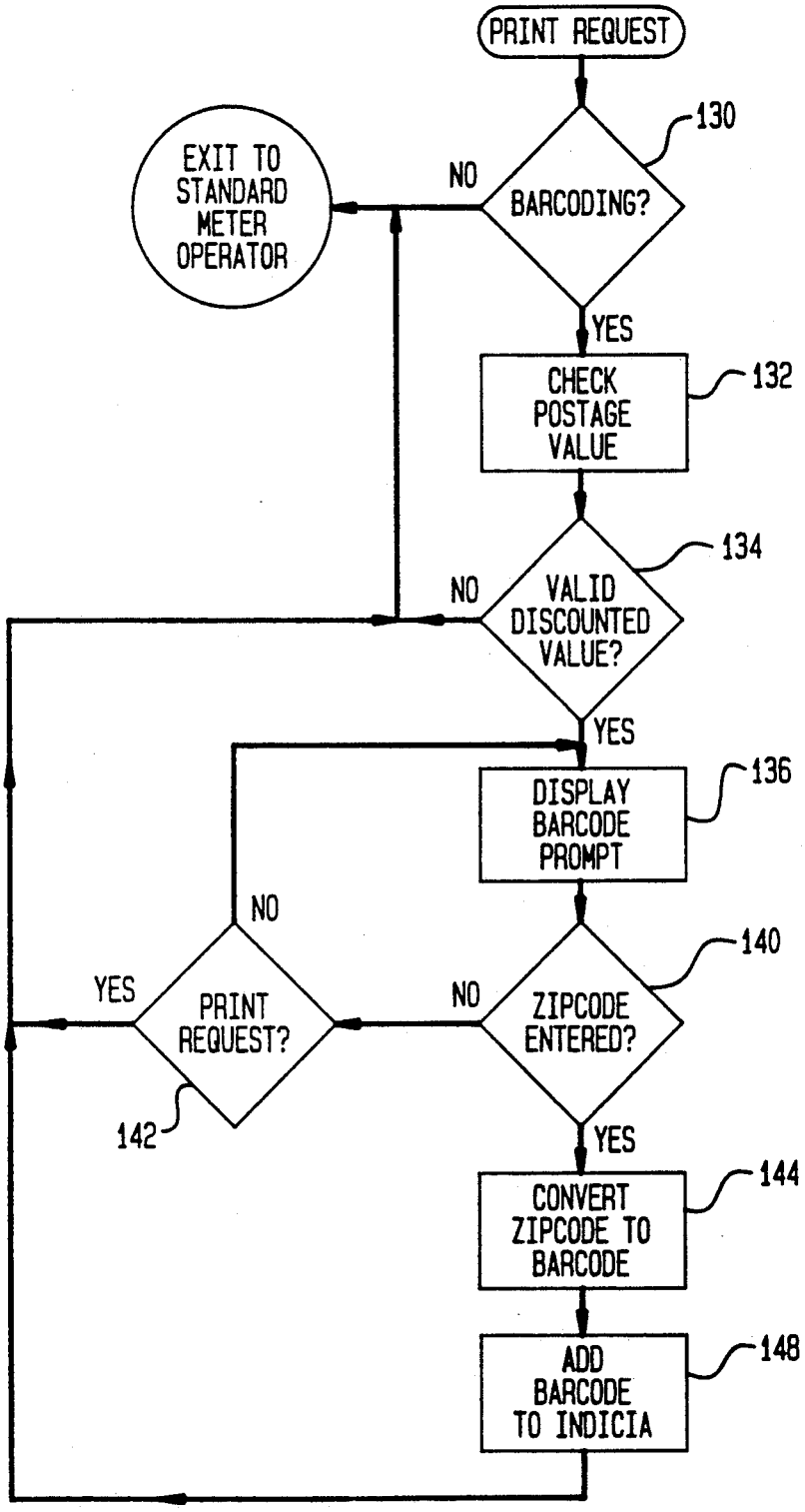
FIG. 6 is a flow chart of an alternative mode of operation of the postage meter of FIG. 4.

FIG. 6 shows a flow chart of another mode of operation of meter 10-2 wherein it is assumed that discounted postage values are initially input. In this embodiment of the subject invention PROM 96 only need store the valid discounted postage values and need not relate them to the undiscounted values.

As above, the operation of meter 10-2 is identical to that shows in FIG. 2 up to the point where the first print request is input.

At 130 the program test to determine if meter 10-2 has been conditioned for barcoding and if not exits to the standard meter operation routine.

At 132 the program tests the input postage value and at 134 determines if it is a valid discount postage value or is an impossible discount value for the discount schedule stored in PROM 96. If it is not a valid value the program exits to the standard meter operation routines. If the postage value is a valid discount value then at 136 CPU 12 controls display 26 to display the barcode prompt to prompt an operator to input a destination zip code.

If at 140 the program determines that the zip code has not been entered then at 142 the program tests to determine if a second print request has been entered. If a second print request has been entered the program exits to the standard meter operation routines. Otherwise, the program loops back through 136.

When a zip code is entered then at 144 the program controls CPU 12 to convert the zip code to a barcode representation, and at 148 adds the barcode representation to the portion of the image stored in RAM 16.

Since the discounted values were initially input the program may then exits to the standard meter operations routines to print the indicia, including the barcode representation of the destination zip code.

Returning to FIG. 4 it can be seen that postage meter 10-2 includes scale port 34 and, since its noted above scale port 34 allows all inputs which can be input through input 22 to be remotely generated and input through port 24, those skilled in the art will readily recognize that operation of meter 10-2 may be easily implemented in an embodiment where appropriate inputs are generated by a modified postal scale and input through scale port 34. The necessary modifications are believed to be well within the skill of a person of ordinary skill in the art and further discussion of these modifications is not believed necessary for an understanding of the subject invention.

Figure 7:
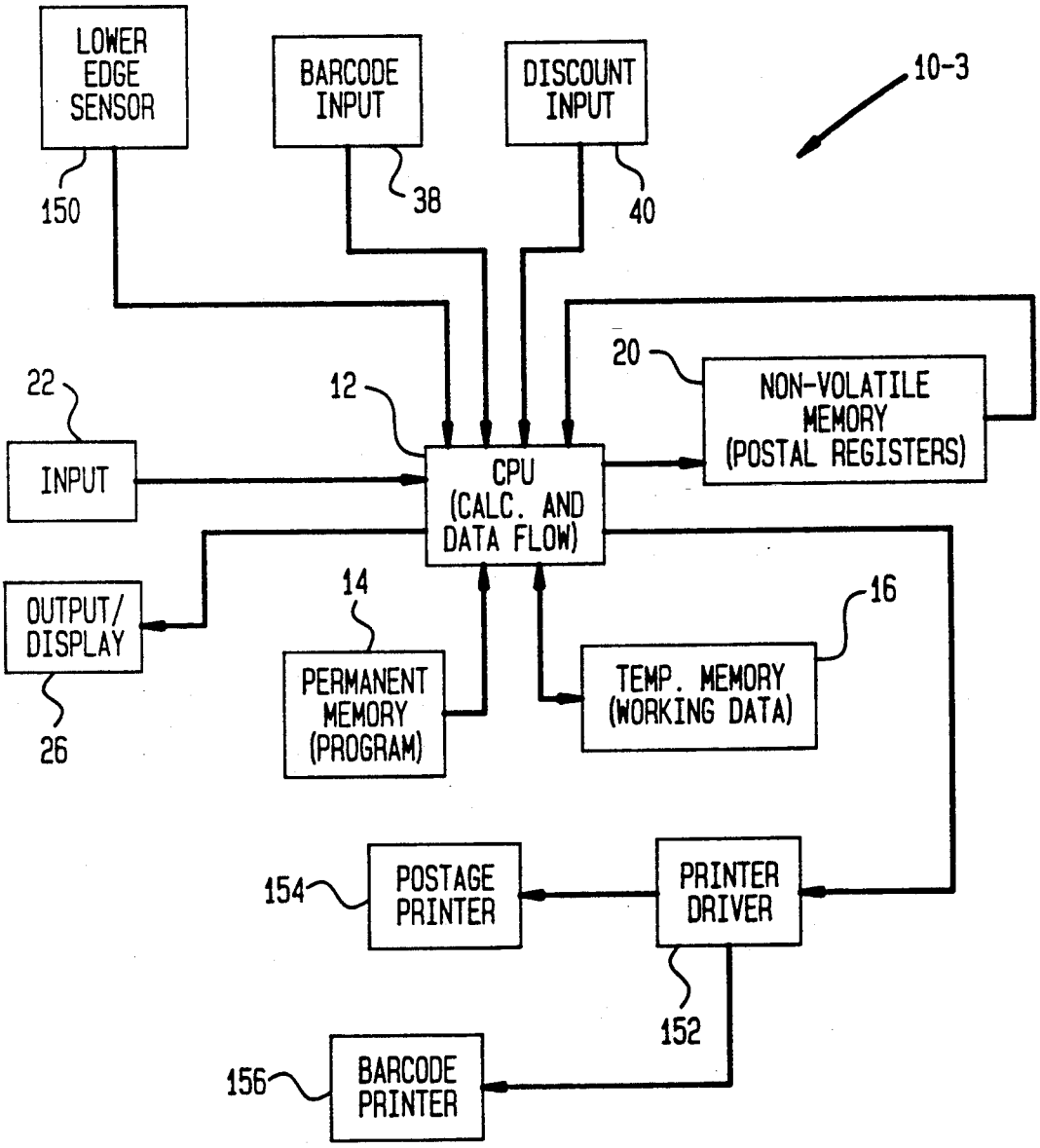
FIG. 7 is a postage meter in accordance with still another embodiment of the subject invention.

Typically, as mail pieces are feed through a postage meter they are guided along their top edge and printing is initiated by the leading (i.e., right) edge of the envelope as it moves through the meter, so that a typical postage meter indicia is register with respect to the upper and right edges of the mail piece. Present regulations of the U.S. Postal Service, however, require that the barcode representation of the destination zip code be registered with respect to the lower and right edges of the mail piece. (However, it should be noted that with the growing capability of barcode scanners it is anticipated that these regulations will be relaxed or eliminated so that ultimately the barcode may be more freely positioned on the mail piece.) Accordingly, FIG. 7 shows postage meter 10-3 which includes the capability to register the barcode representation with respect to the lower edge of a mail piece.

In meter 10-3 CPU 12, memories 14, 16 and 20, input 22, output 26, barcode input 38, and discount input 40 function substantially as described with respect to meter 10-1 and need not be discussed further here for an understanding of the present embodiment of the subject invention. Meter 10-3 also includes lower edge sensor 150, which may be a vertically extending array of photodiodes or a similar mechanism for sensing the position of the lower edge of a mail piece with respect to the upper edge guide of meter 10-3.

Printer driver 152 drives a conventional postage printer 154, which may be either a mechanical, letterpress printer combined with a print wheel mechanism or which may be a matrix printer, or similar print mechanism, for printing an indicia including an encrypted information, as has, in both cases, been discussed above. Printer driver 152 also drives barcode printer 156 which is preferably a matrix printer or similar print mechanism which is physically displaced in the vertical direction from printer 154 to provide a capability for printing along the lower edge of a mail piece. Barcode printer 156 is constructed to have a print field in which an image may be printed which has a vertical dimension great enough to cover the anticipated range of positions of the lower edge of a mail piece.

Meter 10-3 functions exactly as described above with respect to meter 10-1 and FIG. 2, except that CPU 12 is responsive to lower edge sensor 150 to position the barcode representation within the print field of barcode printer 156 with respect to the lower edge of the mail piece and in accordance with the tolerance specified by the regulations of the U.S. Postal Service, or other relevant requirements. Such control of a matrix printer is conventional and need not be described further here for an understanding of the subject invention.

The above detailed description and attached drawings have been provided by way of illustration only and numerous other embodiments of the subject invention will be apparent to those skilled in the art from the description provided above. Particularly, though the above descriptions have been expressed in terms of a single mail piece, it is within the contemplation of the subject invention that the destination zip code may be input once for a number of mail pieces each destined for the same zip code and that these mail pieces may then be processed sequentially through a postage meter in accordance with the subject invention to be printed with the same barcode representation. Accordingly, limitations on the subject invention are to be found only in the claims set forth below.

What is claimed is:

1. A postage meter comprising:

a) input means for input of information, said information including a postage value and a destination zip code;

b) a display;

c) print means for printing an indicia on a mail piece, said indicia including a representation of said postage value and a representation in barcode form of said destination zip code;

d) accounting means for accounting for said postage value when said indicia is printed;

e) means responsive to said input means for:

e1) receiving said postage value;

e2) controlling said display to display prompt requesting input of said destination zip code;

e3) receiving said destination zip code and converting said destination zip code into said barcode representation;

e4) adding said barcode representation to said indicia;

e5) controlling print means to print said indicia; and, e6) controlling said accounting means to account for said postage value.

2. A postage meter as described in claim 1 further comprising means for input of a barcode discount and said control means is further for resetting said postage value to a discounted value in accordance with said barcode discount prior to printing said indicia.

3. A postage meter as described in claim 2 wherein said barcode discount input means comprises switch means presettable to a flat rate discount amount.

4. A postage meter as described in claim 2 wherein said barcode discount means comprises a memory for storing a variable discount rate.

5. A postage meter as described in claim 2 wherein said control means is responsive to input of a print request signal subsequent to display of said prompt and prior to input of said destination zip code to print said indicia without resetting said postage value and without adding said barcode representation.

6. A postage meter as described in claim 2 wherein said control means further comprises a working memory and a non-volatile memory and wherein said flat rate discount amount is stored in said working memory after input and is transferred to said non-volatile memory prior to deenergization of said postage meter.

7. A postage meter as described in claims 2, 3, 4, 5 or 6 further comprising means for input of a barcode signal, said control means for input of a barcode signal, said control means responding to the assertion of said barcode signal to condition display of said prompt, and otherwise printing said indicia without discounting said postage value and without adding said barcode representation.

8. A postage meter as described in claim 7 wherein said barcode signal input means further comprises an interface to a remote device, said remote device determining said discounted value.

9. A postage meter as described in claims 1, 2, 3, 4, 5 or 6 further comprising means for sensing the position of the lower edge of said mail piece, said control means being responsive to said sensing means to control said print means to print said barcode representation in a predetermined relation to said lower edge.

10. A postage meter comprising:

a) input means for input of information said information including a postage value and a destination zip code;

b) a display;

c) print means for printing an indicia on a mail piece, said indicia including a representation of said postage value and a representation in barcode form of said destination zip code;

d) accounting means for accounting for said postage value when said indicia is printed;

e) memory means for storing a plurality of discounted values equal to a plurality of postage value less a barcode discount; and, f) control means responsive to said input means and said memory means for:

f1) receiving said postage value;

f2) determining if said postage to one of said discounted values; and, if so, f3.1) controlling said display to display a prompt requesting input of said destination zip code;

f3.2) receiving said destination zip code and converting said destination zip code into said barcode representation;

f3.3) adding said barcode representations said indicia;

f3.4) controlling said print means to print said indicia; otherwise, f3.5) printing said indicia without adding said barcode representation; and f4) controlling said accounting means to account for said postage value.

11. A postage meter as described in claim 10 wherein said control means is responsive to input of a print request signal subsequent to display of said prompt and prior to input of said destination zip code to print said indicia without resetting said postage value and without adding said barcode representation.

12. A postage meter as described in claim 10 further comprising means for input of a barcode signal, said control means responding to the assertion of said barcode signal to condition display of said prompt, and otherwise printing said indicia without discounting said postage value and without adding said barcode representation.

13. A postage meter as described in claim 12 wherein said barcode signal input means further comprises an interface to a remote device, said remote device determining said discounted value.

14. A postage meter as described in claim 10 further comprising means for sensing the position of the lower edge of said mail piece, said control means being responsive to said sensing means to control said print means to print said barcode representation in a predetermined relation to said lower edge.

15. A system for printing indicia on a mail piece, comprising:

a) a remote device, said device further comprising:

a1) means for determining an undiscounted postage value for said mail piece;

2) means for generation of a barcode signal;

a3) means for determining a barcode discount for said mail piece; and a4) communications means for output of said postage value, said barcode signal and said barcode discount; and b) a postage meter responsive to a print request signal for printing indicia representative of a predetermined postage value, said postage meter further comprising:

b1) a communications port connected to said communications means for input of said barcode signal, said undiscounted postage value and said barcode discount;

b2) input means for input of a destination zip code; and, b3) a display; wherein, b4) said postage meter is condition by said barcode signal to respond to said print request signal by displaying a prompt on said display, said prompt requesting input of said destination zip code; and b5) said postage meter thereafter responding to input of said destination zip code barcode representation of said destination zip code to said indicia, setting said predetermined postage value equal to said undiscounted postage value reduced by said barcode-discount, and printing said indicia.

16. A system for printing indicia on a mail piece, comprising:

a) a remote device, said device further comprising:

a1) means for determining a discounted postage value reflecting a barcode discount for said mail piece;

a2) means for generation of a barcode signal; and a3) communications means for output of said barcode signal and said discounted postage value; and, b) a postage meter responsive to a print request signal for printing an indicia representative of a predetermined postage value, said postage meter further comprising:

b1) a communications port for receiving said barcode signal and said discounted postage value;

b2) input means for input of a destination zip code; and, b3) a display; wherein, b4) said postage meter is conditioned by said barcode signal to respond to said discounted postage value by displaying a prompt requesting input of said destination zip code; and, b5) said postage meter thereafter responding to input of said destination zip code by adding a barcode representation of said destination zip code to said indicia, setting said predetermined postage value equal to said discounted value, and printing said indicia.

* * * * *